United States Patent [19]

Minokami et al.

[11] Patent Number: 4,755,317

[45] Date of Patent: Jul. 5, 1988

[54] WORKING FLUID FOR TRACTION DRIVE

[75] Inventors: Tomiyasu Minokami; Toshiyuki Tsubouchi; Hitoshi Hata, all of Sodegaura, Japan

[73] Assignee: Idemitsu Kosan Company Limited, Tokyo, Japan

[21] Appl. No.: 27,180

[22] Filed: Mar. 18, 1987

[30] Foreign Application Priority Data

Apr. 11, 1986 [JP] Japan ..... 61-82363
Apr. 21, 1986 [JP] Japan ..... 61-90168

[51] Int. Cl.[4] ..... C10M 105/04; C10M 127/02

[52] U.S. Cl. ..... 252/73; 585/1; 585/21; 585/360; 252/9; 252/11

[58] Field of Search ..... 252/73, 9, 11; 585/1, 585/21, 360

[56] References Cited

U.S. PATENT DOCUMENTS 3,411,369 11/1968 Hammann et al. ..... 252/52 R
4,521,324 6/1985 Tsubouchi et al. ..... 252/73
4,604,493 8/1986 Shimizu et al. ..... 252/73
4,609,481 9/1986 Tsubouchi et al. ..... 252/73

*Primary Examiner*—Robert Wax
*Attorney, Agent, or Firm*—Walter H. Schneider

[57] ABSTRACT

The working fluid for traction drive use has a particularly high traction coefficient at high temperatures and the principal ingredient thereof is a decahydronaphthalene compound substituted, on either one or both of the decahydronaphthalene rings, with two or three substituent groups which may be cyclohexyl groups, cyclohexyl alkyl groups, e.g. cyclohexyl methyl, cyclohexyl ethyl, 1-methyl-1-cyclohexyl ethyl and 1-methyl-1-(methylcyclohexyl) ethyl groups, or a combination thereof. The working fluid can be a mixture of a base oil of various types and the above mentioned decahydronaphthalene compound in an amount of 5 to 250 parts by weight per 100 parts by weight of the base oil.

6 Claims, 5 Drawing Sheets

WORKING FLUID FOR TRACTION DRIVE

BACKGROUND OF THE INVENTION

The present invention relates to a novel working fluid for traction drive or, more particularly, to a working fluid for traction drive having a high traction coefficient at high temperatures.

A working fluid for traction drive as usually meant is an oily fluid used in various kinds of traction drive apparatuses, i.e. friction drive apparatuses utilizing rolling contact, such as continuously variable transmission for automobiles and industrial machines, hydraulic instruments and the like. Working fluids for traction drive should satisfy several requirements including a high traction coefficient and stability against heat and oxidation as well as inexpensiveness as a matter of course.

As a trend in recent years, studies in the machinery are directed to a design of smaller and smaller or lighter and lighter traction drive apparatuses with automobiles as a main object of the application thereof. Such a smaller and lighter traction drive apparatus is necessarily operated under operating conditions of increasingly high velocity and high load so that a working fluid for traction drive use also should have greatly improved performance accordingly and development of such an improved working fluid is eagerly desired.

Various compounds have hitherto been proposed as useful for the service as a working fluid for traction drive use including, for example, those disclosed in Japanese Patent Publication Nos. 46-338, 36-339, 47-35763, 48-42067, 48-42068 and 53-36105 and Japanese Patent Kokai No. 55-43108 and 55-40726. These compounds, however, are not free from the problem that the traction coefficient thereof is greatly decreased at a high temperature of, for example, 100° to 160° C.

Several compounds are known to have a high traction coefficient at high temperatures including those proposed in Japanese Patent Publication Nos. 60-1353, 60-1354 and 60-43392 and Japanese Patent Kokai No. 60-35095. These compounds, however, are still not quite satisfactory when the traction drive apparatus is to be operated under severer operating conditions or at still higher temperatures. Therefore, it is an important technical problem to develop a working fluid for traction drive use capable of exhibiting greatly improved performance at high temperatures.

SUMMARY OF THE INVENTION

Accordingly, the present invention has an object to provide a working fluid for traction drive use suitable for use in traction drive apparatuses operated at particularly high temperatures without the above described problems and disadvantages in the conventional working fluids.

Thus, the working fluid for traction drive use provided by the invention comprises a decahydronaphthalene compound having, in a molecule, (i) at least two cyclohexyl alkyl groups, (ii) at least two cyclohexyl groups, or (iii) at least one cyclohexyl alkyl group and at least one cyclohexyl group, bonded to the decahydronaphthalene rings.

DETAILED DESCRIPTION OF THE PREFERRED EMBODIMENTS

Figure 1:
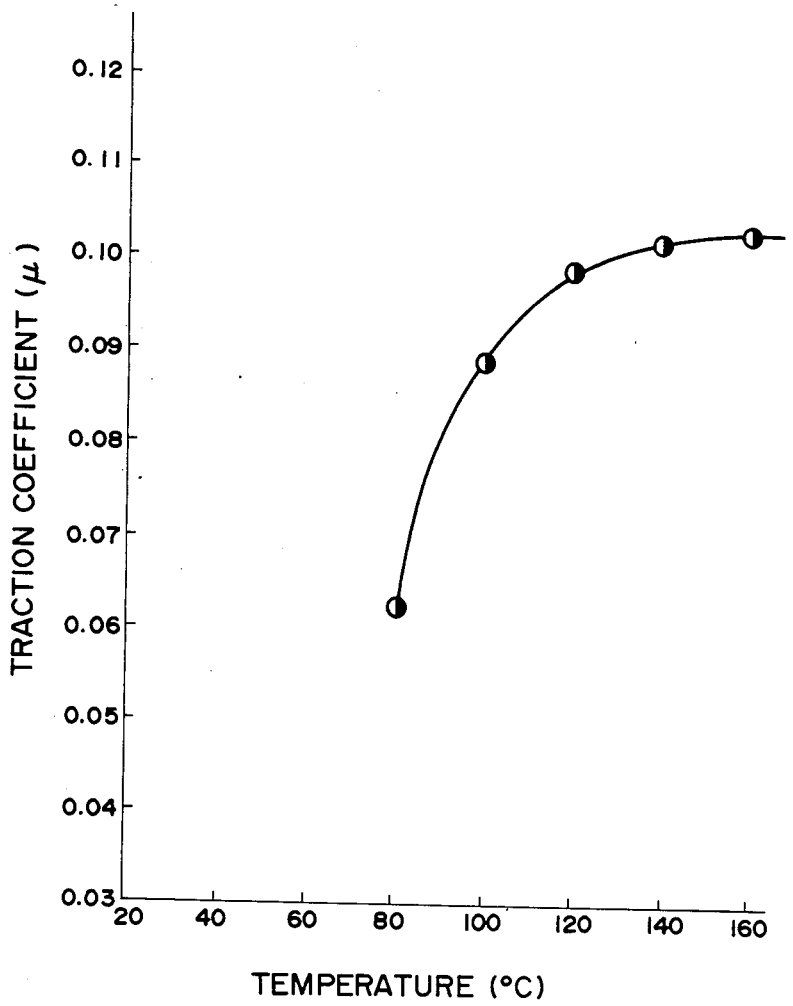
FIG. 1 is a graph showing the relationship between temperature and the traction coefficient of the fluid prepared in Example 1.

As is understood from the above given summary of the invention, the pricipal ingredient in the inventive working fluid for traction drive use is a decahydronaphthalene compound substituted with at least two substituent groups each selected from the class consisting of cyclohexyl alkyl groups and cyclohexyl group.

Various kinds of compounds can be named as the examples of the above defined decahydronaphthalene compound, of which particularly preferable are those represented by the general formula:

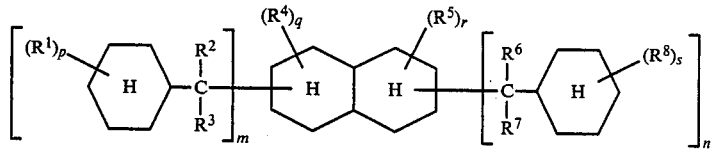

[I]

in which $R^1$, $R^2$, $R^3$, $R^4$, $R^5$, $R^6$, $R^7$ and $R^8$ each denote a hydrogen atom or an alkyl group having 1 to 4 carbon atoms, the subscripts p, q, r and s are each 1, 2 or 3 and the subscripts m and n are each zero, 1, 2 or 3 with the proviso that m+n is equal to 2 or 3. The characteristic feature of these compounds is that two or three cyclohexyl alkyl groups are bonded to one or both of the decahydronaphthalene rings and the bonding therebetween is formed at the α-carbon atom of the cyclohexyl alkyl group relative to the cyclohexane ring. In other words, the carbon atom bonded to the cyclohexane ring should simultaneously be bonded to one of the decahydronaphthalene rings.

Particular examples of the decahydronaphthalene compounds of such a type include:

bis(cyclohexyl methyl)decahydronaphthalenes expressed by the formula:

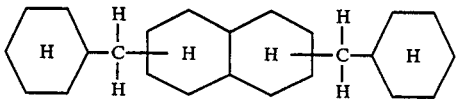

or

-continued

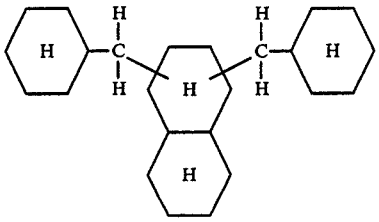

bis(1-cyclohexylethyl)decahydronaphthalenes expressed by the formula

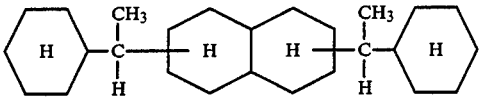

or

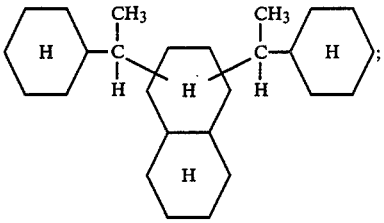

bis(1-methyl-1-cyclohexyl ethyl)decahydronaphthalenes expressed by the formula

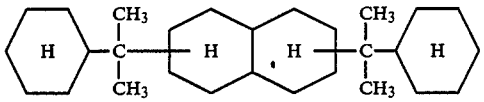

or

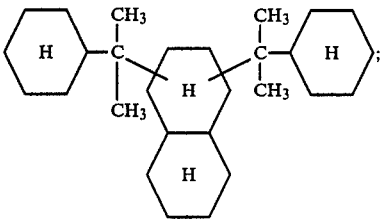

bis(cyclohexyl methyl)methyl decahydronaphthalenes expressed by the formula

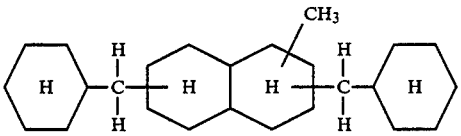

or

-continued

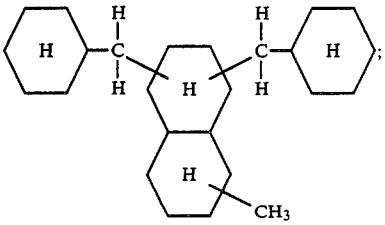

bis(1-cyclohexyl ethyl)methyl decahydronaphthalenes expressed by the formula

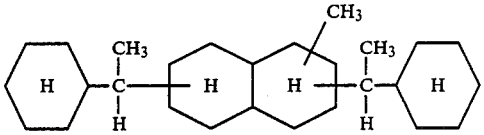

or

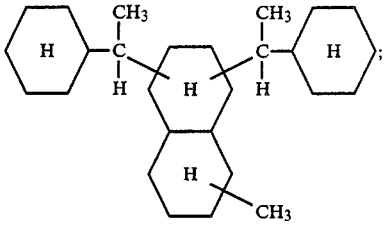

bis(1-methyl-1-cyclohexyl ethyl)methyl decahydronaphthalenes expressed by the formula

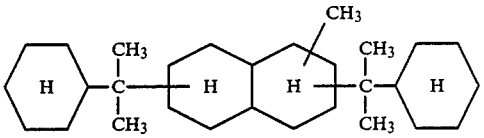

or

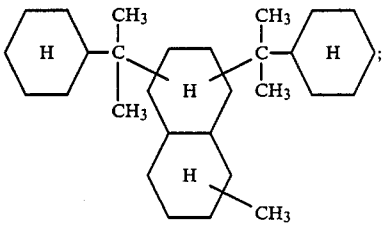

bis(methylcyclohexyl methyl)decahydronaphthalenes expressed by the formula

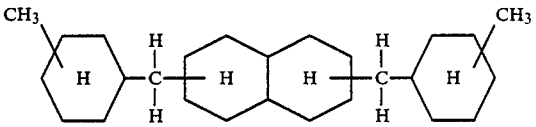

or

-continued

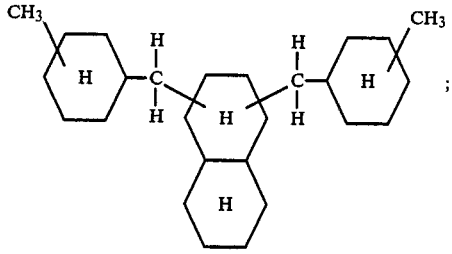

bis[1-(methylcyclohexyl)ethyl]decahydronaphthalenes expressed by the formula

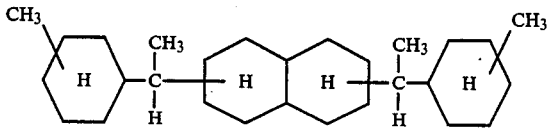

or

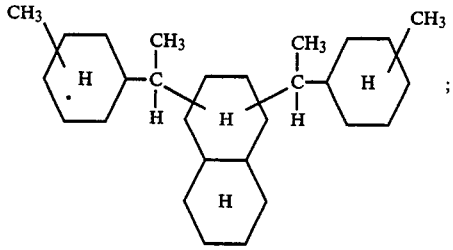

bis[1-methyl-1-(methylcyclohexyl)ethyl]decahydronaphthalenes expressed by the formula

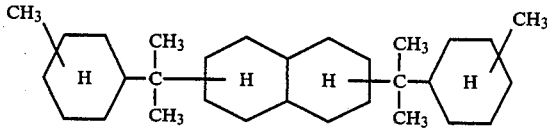

or

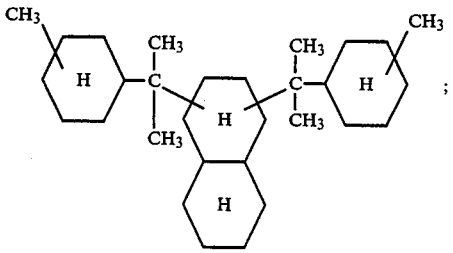

bis(methylcyclohexyl methyl)methyl decahydronaphthalenes expressed by the formula

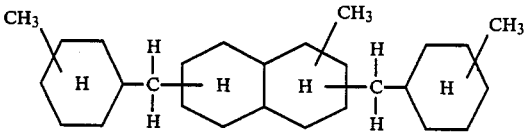

or

-continued

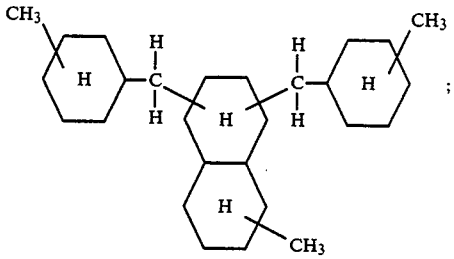

bis[1-(methylcyclohexyl)ethyl]methyl decahydronaphthalenes expressed by the formula

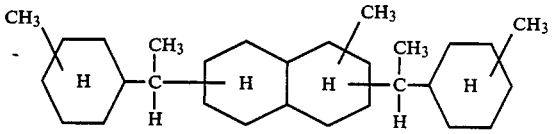

or

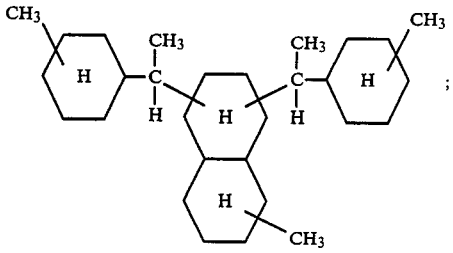

bis[1-methyl-1-(methylcyclohexyl)ethyl]methyl decahydronaphthalenes expressed by the formula

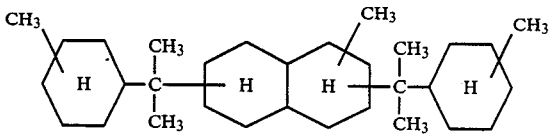

or

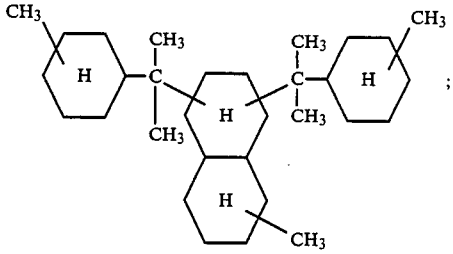

tris(cyclohexyl methyl)decahydronapthalenes expressed by the formula

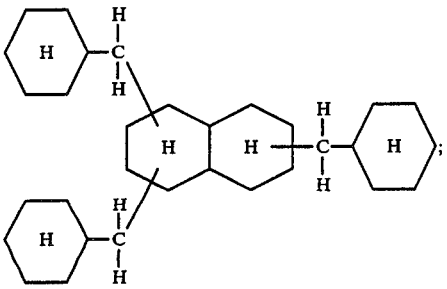

tris(1-cyclohexyl ethyl)decahydronaphthalenes expressed by the formula

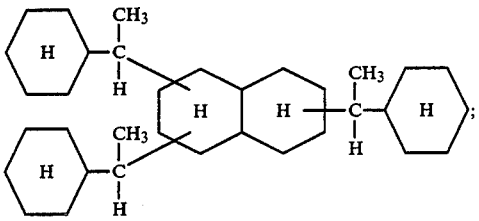

and the like.

Although the cyclohexylalkyl group should be bonded to the decahydronaphthalene rings preferably at the α-carbon atom relative to the cyclohexane ring, usable cyclohexylalkyl-substituted decahydronaphthalene compounds include those in which the cyclohexylalkyl group is bonded to the decahydronaphthalene rings at the β- or γ-carbon atom relative to the cyclohexane ring. In other words, the decahydronaphthalene rings and the cyclohexane ring may be bonded together through a link of two or three carbon atoms intervening therebetween.

In addition to the above described decahydronaphthalene compounds having two or three cyclohexylalkyl groups in a molecule, the principal ingredient in the inventive working fluid for traction drive use can be a decahydronaphthalene compound having two or more cyclohexyl groups or a combination of one or more cyclohexylalkyl groups and one or more of cyclohexyl groups in a molecule. It is optional that the decahydronaphthalene and cyclohexane rings are substituted with 1 to 3 alkyl groups having 1 to 4 carbon atoms. Particular examples of these compounds include dicyclohexyl decahydronaphthalenes expressed by the formula

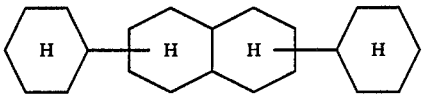

or

-continued

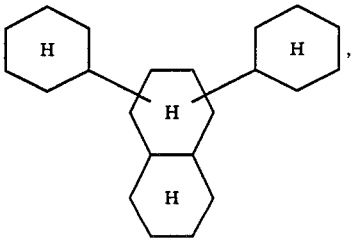

1-cyclohexylethyl cyclohexyl decahydronaphthalenes expressed by the formula

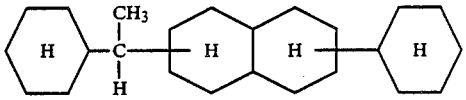

and the like.

The inventive working fluid for traction drive use may comprise either a single kind or a combination of two kinds or more of the above described decahydronaphthalene compounds.

The above described decahydronaphthalene compounds can be prepared by various known methods without particular limitations. For example, the cyclohexylalkyl-substituted decahydronaphthalenes represented by the general formula [I] can be synthesized most conveniently from naphthalene or a substituted naphthalene represented by the general formula

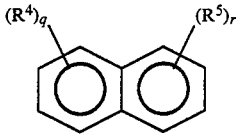

or tetrahydronaphthalene or a substituted tetrahydronaphthalene represented by the general formula

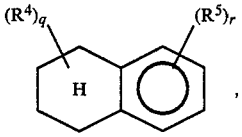

in which $R^4$, $R^5$, q and r each have the same meaning as defined for the general formula [I], as the starting material. Namely, these naphthalene or tetrahydronaphthalene compounds are reacted with a halogenated alkylbenzene or a derivative thereof represented by the general formula

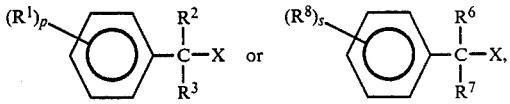

or styrene or a derivative thereof represented by the general formula

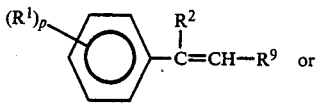

or

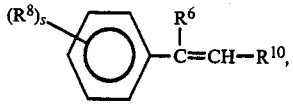

in which $R^1$, $R^2$, $R^3$, $R^6$, $R^7$, $R^8$, p and s each have the same meaning as defined for the general formula [I], $R^9$ and $R^{10}$ are each an alkyl group having carbon atoms smaller in number by one than $R^3$ and $R^7$, if $R^3$ and/or $R^7$ are hydrogen or methyl, $R^9$ and/or $R^{10}$ are hydrogen) respectively, and X is a halogen atom, in the presence of a catalyst. Though dependent on the type of the desired decahydronaphthalene compound, the catalyst used in this reaction should usually be selected from the group consisting of ordinary Friedel-Crafts catalysts such as sulfuric acid, aluminum chloride and the like, heteropolyacids such as phosphotungstic acid, silicotungstic acid, phosphomolybdic acid, silicomolybdic acid and the like and salts thereof, activated clay, acid clay, silica alumina, solid phosphoric acid, ion-exchange resins, titanium dioxide, zeolites and the like. The reaction product thus obtained is then subjected to fractionation by, for example, distillation under reduced pressure and the fractions containing the compounds represented by the general formula

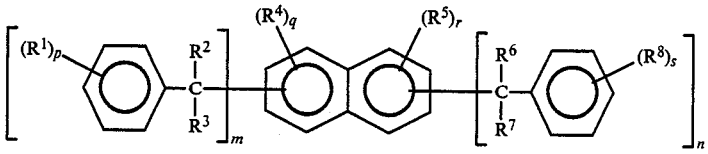

or

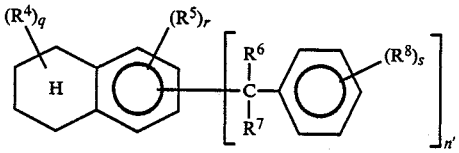

in which $R^1$, $R^2$, $R^3$, $R^4$, $R^5$, $R^6$, $R^7$, $R^8$, p, q, r, s, m and n each have the same meaning as defined for the general formula [I] and n' is 2 or 3, are subjected to a hydrogenation treatment to give the desired decahydronaphthalene compounds of the general formula [I]. The hydrogenation treatment can be performed according to a known procedure using a catalyst which may be any of conventional ones containing a noble metal, e.g. ruthenium, platinum, rhodium, iridium and palladium, nickel, molybdenum and the like.

The thus obtained compounds or, in particular, the substituted decahydronaphthalene compounds of the general formula [I] can be used as such as a working fluid for traction drive use although it is optional to admix the same with various kinds of known additives according to need. The inventive working fluid for traction drive use described above has a high traction coefficient at a high temperature of, for example, 100° to 160° C. in addition to the excellent general properties in other respects so that it is quite satisfactory as a working fluid used in traction drive apparatuses operated under a condition of particularly high temperatures. Accordingly, the applicability of the inventive working fluid for traction drive use covers a wide variety of machinery including continuously variable transmissions for automobiles and industrial machines, hydraulic instruments and so on.

When the working fluid for traction drive use should desirably have a high traction coefficient over a wide temperature range from low to high temperatures in addition to the excellent general properties without the problems of poor flowability at low temperatures and discontinuity of oil film at high temperatures, the working fluid should be formulated by combining a decahydronaphthalene compound having, in a molecule, (i) at least two cyclohexyl alkyl group, (ii) at least two cyclohexyl groups, or (iii) at least one cyclohexyl alkyl group and at least one cyclohexyl group, bonded to the decahydronaphthalene rings with a base oil having a kinematic viscosity of 8 centistokes or below or, preferably, 7 centistokes or below at 100° C.

Preferable base oils suitable for the purpose include naphthenic base oils, aromatic base oils, paraffinic base oils, silicone-based base oils, esteric base oils and the like as well as mixtures thereof. Particularly preferable among them are the naphthenic ones, of which examples include: 1-(2-decahydronaphthyl)-1-cyclohexyl ethane; 1-(1-decahydronaphthyl)-1-cyclohexyl ethane; 1-(2-methyl decahydronaphthyl)-1-cyclohexyl ethane; 1-(1-methyl decahydronaphthyl)-1-cyclohexyl ethane; 1-dimethyl-decahydronaphthyl-1-cyclohexyl ethane; 2-(2-decahydronaphthyl)-2-cyclohexyl propane; 2-(1-decahydronaphthyl)-2-cyclohexyl propane; 1-cyclohexyl-1,4-dimethyl decahydronaphthalene; 1,2-di(methyl cyclohexyl)-2-methyl propane; 2,3-di(methyl cyclohexyl) butane; 1,3-dicyclohexyl-3-methyl butane; 2,4-dicyclohexyl pentane; 2,4-dicyclohexyl-2-methyl pentane; 1,3-dicyclohexyl-1-methyl cyclopentane; tercyclohexyl; cyclohexylmethyl decahydronaphthalene; 1-dicyclohexyl-1-cyclohexyl ethane; naphthenic mineral oils and the like.

The aromatic base oil is exemplified by the hard-type alkyl benzenes obtained by the reaction of a propylene polymer and benzene, soft-type alkyl benzenes obtained by the reaction of an α-olefin and benzene, alkyl naphthalenes such as diisopropyl naphthalene and the like, alkyl biphenyls such as diethyl biphenyl and the like, diaryl alkanes such as phenyl xylyl ethane, benzyl naphthalene and the like, and others. The paraffinic base oil is exemplified by poly-α-olefins, paraffinic mineral oils, polybutenes, propylene oligomers, squalane and the like.

The silicone-based base oil includes silicone fluids such as dimethyl silicones and phenyl methyl silicones and the esteric base oil includes polyol esters and diesters, cyclohexane carboxylic acid esters of cycloalkanols such as cyclohexane carboxylic acid esters of cyclohexanol and cyclododecanol, phosphate esters such as tricyclohexyl phosphate and others.

These base oils can be used either singly or as a combination of two kinds or more according to need. Any of such combinations can be used provided that the kinematic viscosity of the mixture does not exceed 8 centistokes at 100° C. even when one of the component compounds has a kinematic viscosity higher than 8 centistokes at 100° C.

The use of the above described base oil in combination with a decahydronaphthalene compound having, in a molecule, (i) at least two cyclohexyl alkyl group, (ii) at least two cyclohexyl groups, or (iii) at least one cyclohexyl alkyl group and at least one cyclohexyl group, bonded to the decahydronaphthalene rings has a remarkable synergistic effect in respect of the improvement of the traction coefficient of the mixture to give a working fluid for traction drive use having excellent properties.

It is taught in ASLE Trans., volume 13, pages 105 to 116 (1969) that the rule of additivity is held for the traction coefficient according to the equation $$f = \sum_i C_i f_i ,$$

in which $C_i$ is the weight fraction of the i-th component, $f_i$ is the traction coefficient of the i-th component and f is the traction coefficient of the mixture of the i components.

Although it is reported in SAE 710837 (1971) that a slight synergistic effect is obtained in the traction coefficient of a mixture of components, the reported increment over the additivity rule is only 2 to 3% so that it is a quite novel discovery that the traction coefficient of a mixture exceeds the value of any one of the components before blending or the traction coefficient of a mixture is larger by at least 10% than the value expected from the rule of additivity.

When the working fluid for traction drive use is prepared by mixing the above described base oil and a decahydronaphthalene compound having, in a molecule, (i) at least two cyclohexyl alkyl group, (ii) at least two cyclohexyl groups, or (iii) at least one cyclohexyl group and at least one cyclohexyl group, bonded to the decahydronaphthalene rings, the mixing ratio is not particularly limitative provided that the mixture has a kinematic viscosity of at least 3.0 centistokes or, preferably, in the range from 3.6 to 10.0 centistokes at 100° C. Though dependent on the particular types of the respective component compounds, it is a general guideline that 100 parts by weight of the base oil should be admixed with from 5 to 250 parts by weight or, preferably, from 8 to 150 parts by weight of a decahydronaphthalene compound having, in a molecule, (i) at least two cyclohexyl alkyl group, (ii) at least two cyclohexyl groups, or (iii) at least one cyclohexyl alkyl group and at least one cyclohexyl group, bonded to the decahydronaphthalene rings. Even when the mixing ratio of the components is within the above mentioned range, it is a further requirement that the mixture should have a kinematic viscosity of at least 3 centistokes at 100° C. since otherwise the traction drive apparatus using the mixture as the working fluid cannot withstand a continuous running over a long period of time to ensure the rating life of the apparatus due to the fatigue by rolling.

As is known, rolling-element fatigue life largely depends on the surface roughenss of each of the rolling contact surfaces and the thickness of the oil film formed therebetween and can be estimated in relation to the value of the oil film parameter Λ. In connection with the relationship between the value of Λ and surface fatigue, it is taught in Machine Design, volume 7, page 102 (1974) that the rating life or longer of the surface can be ensured when it is larger than 0.9.

When a calculation is made by applying the above described criterion to an actual bearing as an example of the rolling-contact surface, a conclusion is made that the life of the surface due to fatigue by rolling can exceed the rating value or the value expected by design when the working fluid has a viscosity of at least 3.0 centistokes or, preferably, at least 3.6 centistokes at 100° C. In other words, a working fluid for traction drive use, when it is prepared by blending two or more components, should be formulated so as to have a viscosity of at least 3.0 centistokes, or preferably, at least 3.6 centistokes at 100° C. In addition, a working fluid for traction drive use to be used in automobiles should preferably have a pour point of −30° C. or lower in order to facilitate smooth starting of the engine in a cold district.

In the following, the inventive working fluids for traction drive use and the performance thereof are illustrated in more detail by way of examples and comparative examples.

In the Examples and Comparative Examples described below, the traction coefficient of the working fluids was measured using a two roller machine. The machine had two rollers each having a diameter of 52 mm and a thickness of 6 mm contacting each other at the side faces with a contacting load of 7 kg by means of a spring in such a manner that one of the wheels could drive the other. The side face of the driving roller was straightly cylindrical without crowning while the side face of the driven roller had a barrel-shaped form with a crown radius of 10 mm. One of the rollers was rotated at a constant velocity of 1500 rpm while the other roller was continuously rotated at a velocity of 1500 rpm to 1750 rpm so as to determine the tangential force, i.e. traction force, generated between the rollers, from which the traction coefficient was calculated. The rollers were made of a steel for rolling bearing SUJ-2 and the surface thereof was polished as smooth as a mirror.

The maximum Hertzian contact pressure was 112 kgf/mm$^2$.

The relationship between the traction coefficient and the temperature of the working fluid was determined at a slip ratio of 5% by varying the temperature of the fluid in the oil reservoir equipped with a heater in the range from 30° C. to 160° C.

EXAMPLE 1

Into a four-necked flask of 3-liter capacity equipped with a reflux condenser, thermometer and stirrer were introduced 896 g (7 moles) of naphthalene and 44.8 g of a silica gel-supported heteropolyacid catalyst containing 17% by weight of phosphotungstic acid and the mixture was heated at 150° C. Then, 1092 g (10.5 moles) of styrene were added dropwise into the mixture in the flask kept at 150° C. under agitation over a period of 8 hours and, after completion of the dropwise addition of styrene, the mixture was further agitated for additional 30 minutes at 150° C. to complete the reaction. After completion of the reaction, the solid catalyst was immediately removed from the mixture by filtration and the filtrate was subjected to distillation under reduced pressure to give about 800 g of a fraction boiling at 230° to 250° C. under a pressure of 0.6 mmHg. This fraction was analyzed by the gas chromatographic-mass spectrometric analysis and proton NMR analysis to find that the main constituent thereof was bis(1-phenyl ethyl)-naphthalene as an addition product of 2 moles of styrene to 1 mole of naphthalene.

In the next place, a 500 g portion of this fraction was introduced into an autoclave of 1-liter capacity together with 25 g of a hydrogenation catalyst containing 5% by weight of ruthenium supported on carbon carrier (a product by Nippon Engelhard Co.) and the hydrogenation reaction of the naphthalene compound was performed for 4 hours at a reaction temperature of 200° C. under a hydrogen pressure of 100 kg/cm$^2$. After cooling, the reaction mixture was filtered to remove the catalyst and the filtrate was analyzed by the NMR analysis to find that more than 99% of the starting naphthalene compound had been hydrogenated and the main constituent of the filtrate was bis(1-cyclohexyl ethyl)-decahydronaphthalene as the nucleus-hydrogenated compound of bis(1-phenyl ethyl)naphthalene. This product had a kinematic viscosity of 60 centistokes at 100° C. and a refractive index $n_D^{20}$ of 1.5084. This product had a very high traction coefficient at high temperatures with a value of 0.102 at 140° C. FIG. 1 of the accompanying drawing shows the traction coefficient of the product as a function of temperature.

COMPARATIVE EXAMPLE 1

Into a glass-made flask of 3-liter capacity were introduced 1000 g of α-methyl styrene, 50 g of acid clay and 50 g of ethylene glycol and the mixture was agitated for 2 hours at 140° C. to effect the reaction. After cooling, the reaction mixture was filtered to remove the acid clay and then the filtrate was distilled to remove the unreacted α-methyl styrene and ethylene glycol and to give 900 g of a fraction boiling at 125° to 130° C. under a pressure of 0.2 mmHg. This fraction was identified by the NMR and gas chromatographic analyses to be a mixture of 95% of a linear dimer and 5% of a cyclic dimer of α-methyl styrene.

The thus obtained fraction was subjected to a hydrogenation reaction and post-treatment in the same manner as in Example 1 to give a hydrogenation product usable as a working fluid for traction drive use, of which the main constituent was 2,4-dicyclohexyl-2-methyl pentane. This product had a refractive index $n_D^{20}$ of 1.4902, specific gravity (15/4° C.) of 0.90 and kinematic viscosity of 3.7 centistokes at 100° C. The traction coefficient thereof was 0.063 at 140° C.

EXAMPLE 2

(1) Preparation of base oil

Into a glass-made flask of 3-liter capacity were introduced 1000 g of tetrahydronaphthalene and 300 g of concentrated sulfuric acid and the mixture was chilled at 0° C. by keeping the flask in an ice bath. Then, 400 g of styrene were added dropwise into the mixture in the flask under agitation over a period of 3 hours followed by further continued agitation for additional 1 hour to complete the reaction. The mixture was kept standing still with the stirrer turned off so that the mixture was separated into two layers. The organic phase taken by phase separation was washed first with 500 ml of a 1N aqueous solution of sodium hydroxide and then with 500 ml of a saturated aqueous solution of sodium chloride each three times followed by drying over anhydrous sodium sulfate and, after stripping of the unreacted tetrahydronaphthalene by distillation, subjected to distillation under reduced pressure to give 750 g of a fraction boiling at 135° to 148° C. under a pressure of 0.17 mmHg. This fraction could be identified by analysis to be a mixture of 1-(2-tetrahydronaphthyl)-1-phenyl ethane and 1-(1-tetrahydronaphthyl)-1-phenyl ethane.

A 500 g portion of this fraction was taken in an autoclave of 1-liter capacity together with 25 g of a hydrogenation catalyst containing 5% by weight of ruthenium supported on carbon (a product by Nippon Engelhard Co.) and the hydrogenation reaction was performed for 4 hours at a reaction temperature of 200° C. under a hydrogen pressure of 50 kg/cm$^2$. After cooling, the reaction mixture was filtered to remove the catalyst and the filtrate was stripped of the low boiling matter. The thus obtained product had a specific gravity (15/4° C.) of 0.94, refractive index $n_D^{20}$ of 1.5040 and the kinematic viscosity thereof was 35.76 centistokes at 40° C. and 4.709 centistokes at 100° C. Analysis of the product by the NMR method indicated that more than 99.9% of the starting compounds had been hydrogenated and it could be identified to be a mixture of 1-(2-decahydronaphthyl)-1-cyclohexyl ethane and 1-(1-decahydronaphthyl)-1-cyclohexyl ethane.

(2) Preparation of a mixed fluid for traction drive use

Figure 2:
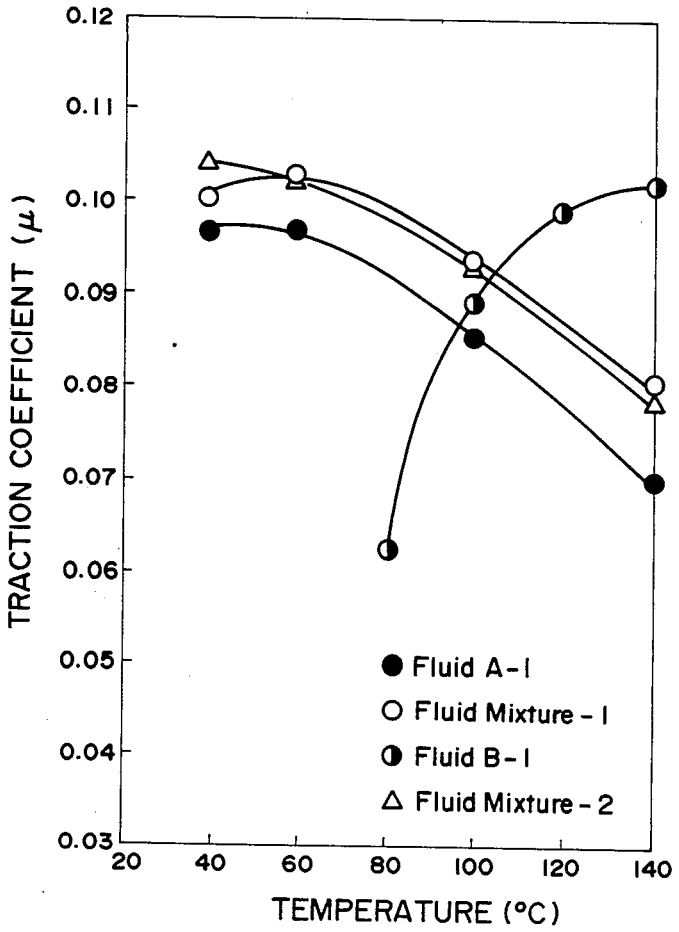
FIGS. 2 to 5 are each a similar graphic showing of the traction coefficient of the respective fluid prepared in other Examples and Comparative Examples as a function of temperature.

A mixed working fluid for traction drive use, which is referred to as the mixed fluid-1 hereinbelow, was prepared by blending 78 parts by weight of the fluid prepared in (1) above and mainly composed of 1-(2-decahydronaphthyl)-1-cyclohexyl ethane, which is referred to as the fluid A-1 hereinbelow, and 22 parts by weight of the fluid prepared in Example 1 and mainly composed of bis(1-cyclohexyl ethyl)decahydronaphthalene, which is referred to as the fluid B-1 hereinbelow. Properties of this mixed fluid-1 are shown in Table 1 below and the traction coefficient thereof is shown in FIG. 2 as a function of temperature.

EXAMPLE 3

A mixed working fluid for traction drive use, which is referred to as the mixed fluid-2 hereinbelow, was prepared by blending 90 parts by weight of the fluid A-1 and 10 parts by weight of the fluid B-1. Properties of this mixed fluid-2 are shown in Table 1 below and the traction coefficient thereof is shown in FIG. 2 as a function of temperature.

COMPARATIVE EXAMPLE 2

Properties of the fluid A-1 used in Example 2 are shown in Table 1 and the traction coefficient thereof is shown in FIG. 2 as a function of temperature.

COMPARATIVE EXAMPLE 3

Properties of the fluid B-1 used in Example 2 are shown in Example 2 are shown in Table 1 and the traction coefficient thereof is shown in FIG. 2 as a function of temperature.

TABLE 1

| No. | Fluid | Item: Kinematic viscosity, centistokes, at 40° C. | 100° C. | Viscosity index | Pour point, °C. |
|---|---|---|---|---|---|
| Example 2 | Mixed fluid-1 | 80.47 | 6.769 | −29 | −25.0 |
| Example 3 | Mixed fluid-2 | 55.38 | 5.678 | −18 | −27.5 |
| Comparative Example 2 | Fluid A-1 | 35.76 | 4.709 | −5 | −30.0 |
| Comparative Example 3 | Fluid B-1 | — | 59.75 | — | — |

EXAMPLE 4

(1) Preparation of base oil

Into a glass-made flask of 3-liter capacity were introduced 1000 g of α-methyl styrene, 40 g of acid clay and 50 g of mesityl oxide and the mixture was heated at 140° C. for 2 hours under agitation to effect the reaction. After cooling, the reaction mixture was filtered to remove the acid clay as the catalyst and the filtrate was stripped of the unreacted α-methyl styrene and mesityl oxide and distilled under reduced pressure to give 900 g of a fraction boiling at 125° to 130° C. under a pressure of 0.2 mmHg. This fraction was identified by the NMR and gas chromatographic analyses to be a mixture of 97% and 3% of a linear dimer and a cyclic dimer, respectively, of α-methyl styrene.

This fraction was subjected to the hydrogenation reaction and post-treatment in substantially the same manner as in (1) of Example 2 to give a fluid mainly composed of 2,4-dicyclohexyl-2-methyl pentane and suitable for use as a working fluid for traction drive use. This product had a specific gravity (15/4° C.) of 0.90 and the kinematic viscosity thereof was 20.27 centistokes at 40° C. and 3.580 centistokes at 100° C. with a viscosity index of 13.

(2) Preparation of a mixed fluid for traction drive use

A mixed working fluid for traction drive use, which is referred to as the mixed fluid-3 hereinbelow, was prepared by blending 73 parts by weight of the product obtained in (1) above and mainly composed of 2,4-dicyclohexyl-2-methyl pentane, which is referred to as the fluid A-2 hereinbelow, and 27 parts by weight of the fluid B-1. Properties of the mixed fluid-3 are shown in Table 2 below and the traction coefficient thereof is shown in FIG. 3 as a function of temperature.

COMPARATIVE EXAMPLE 4

Figure 3:
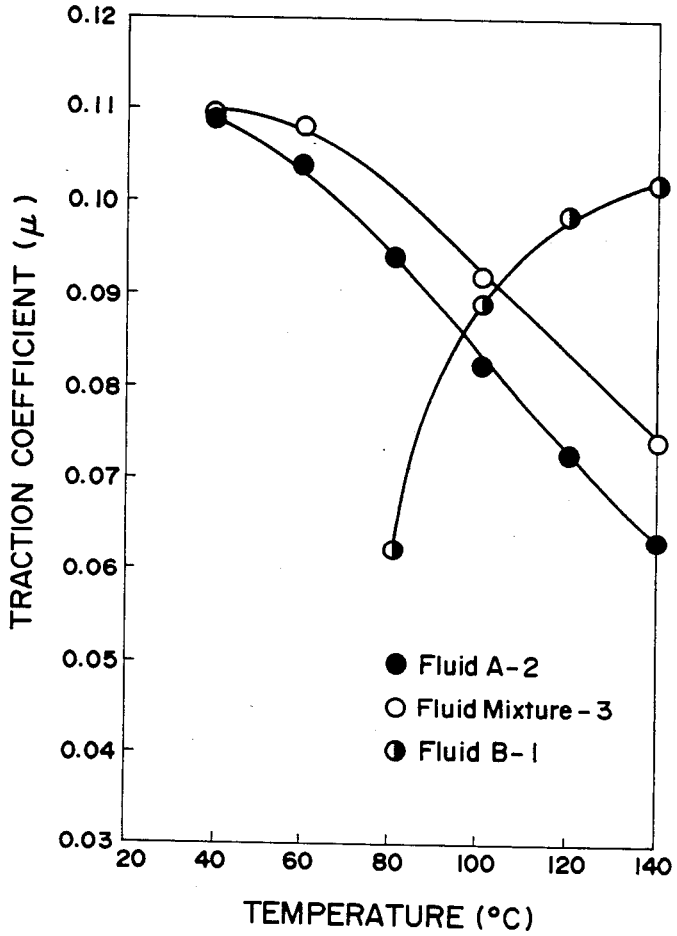

Properties of the fluid A-2 obtained in (1) of Example 4 are shown in Table 2 and the traction coefficient thereof is shown in FIG. 3 as a function of temperature. Table 2 and FIG. 3 also contain the data for the fluid B-1 to facilitate comparison.

TABLE 2

| No. | Fluid | Item: Kinematic viscosity, centistokes, at 40° C. | 100° C. | Viscosity index | Pour point, °C. |
|---|---|---|---|---|---|
| Example 4 | Mixed fluid-3 | 69.62 | 6.215 | −36 | −27.5 |
| Comparative Example 4 | Fluid A-2 | 20.27 | 3.580 | 13 | below −35 |
| Comparative Example 3 | Fluid B-1 | — | 59.75 | — | — |

EXAMPLE 5

Reaction of naphthalene and styrene was performed in substantially the same manner as in Example 1 except that 150 g of an acid clay calcined beforehand at 220° C. for 20 hours were used as the catalyst. After completion of the reaction, the reaction mixture was filtered to remove the catalyst and the filtrate was stripped of the unreacted naphthalene. The resultant reaction product was analyzed and identified to be a mixture composed of 32% by weight of 1-phenyl-1-naphthyl ethane, 43% by weight of bis(1-phenethyl)naphthalene and 23% by weight of tris(1-phenethyl)naphthalene. This mixture was subjected to a hydrogenation reaction in the same manner as in Example 1 using a Raney nickel catalyst (Raney Nickel NDH, a product by Kawaken Fine Chemical Co.) to give a fluid which contained 32% by weight of 1-cyclohexyl-1-decahydronaphthyl ethane, 43% by weight of bis(1-cyclohexyl ethyl)decahydronaphthalene and 23% by weight of tris(1-cyclohexyl ethyl)decahydronaphthalene.

EXAMPLE 6

Figure 4:
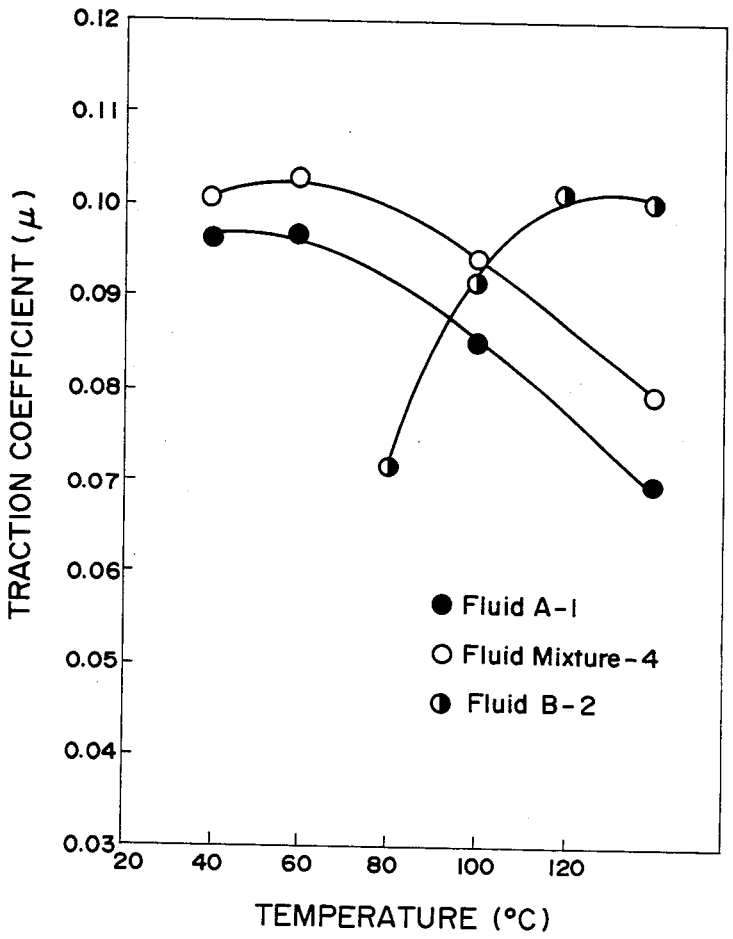

A mixed working fluid for traction drive use, which is referred to as the mixed fluid-4 hereinbelow, was prepared by blending 73 parts by weight of the fluid A-1 obtained in (1) of Example 2 and 27 parts by weight of the fluid obtained in Example 5, which is referred to as the fluid B-2 hereinbelow. Properties of this mixed fluid-4 are shown in Table 3 below and the traction coefficient thereof is shown in FIG. 4 as a function of temperature. Table 3 also shows the properties of the fluid B-2 obtained in Example 5. Table 3 and FIG. 4 also show the data for the fluid A-1 to facilitate comparison.

TABLE 3

| No. | Fluid | Item: Kinematic viscosity, centistokes, at 40° C. | 100° C. | Viscosity index | Pour point, °C. |
|---|---|---|---|---|---|
| Example 6 | Mixed fluid-4 | 81.24 | 6.893 | −20 | −25.0 |
| Comparative Example 2 | Fluid A-1 | 35.76 | 4.709 | −5 | −30.0 |
| Example 5 | Fluid B-2 | 4471 | 34.11 | −407 | +10.0 |

EXAMPLE 7

(1) Preparation of base oil

Into a mixture in a four-necked flask of 2-liter capacity composed of 500 ml of toluene, 158 g (2 moles) of pyridine and 396 g (2 moles) of cyclododecanol were added dropwise 293 g (2 moles) of cyclohexane carbonyl chloride at a temperature of 45° to 75° C. over a period of 2.5 hours under agitation followed by further continued agitation for additional 1 hour at the same temperature to complete the reaction. After cooling to room temperature, the reaction mixture was filtered using a Buchner funnel to remove the precipitates of pyridine hydrochloride. The filtrate was stripped of toluene and then subjected to distillation under reduced pressure to give 445 g of a fraction boiling at 160° to 170° C. under a pressure of 0.2 mmHg, which could be identified by analysis to be an ester of cyclododecanol and cyclohexane carboxylic acid.

(2) Preparation of a mixed fluid for traction drive use

A mixed fluid, which is referred to as the mixed fluid-5 hereinbelow, was prepared by blending 86 parts by weight of the product obtained in (1) above and mainly composed of the ester of cyclododecanol and cyclohexane carboxylic acid, which is referred to as the fluid A-3 hereinbelow, and 14 parts by weight of the fluid B-2 prepared in Example 5. Properties of this mixed fluid-5 are shown in Table 4 below and the traction coefficient thereof is shown in FIG. 5 as a function of temperature.

COMPARATIVE EXAMPLE 5

Figure 5:
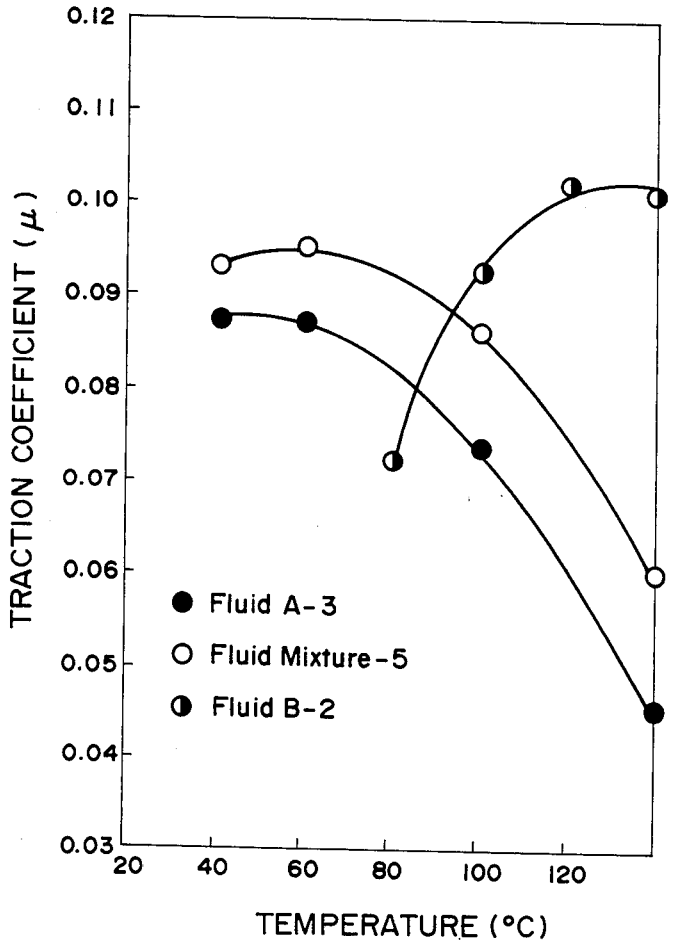

Properties of the fluid A-3 are shown also in Table 4 and the traction coefficient thereof is shown also in FIG. 5 as a function of temperature. Table 4 and FIG. 5 also show the data for the fluid B-2 to facilitate comparison.

TABLE 4

| | Item | | | | |
|---|---|---|---|---|---|
| | | Kinematic viscosity, centistokes, at | | Viscosity | Pour point, |
| No. | Fluid | 40° C. | 100° C. | index | °C. |
| Example 7 | Mixed fluid-5 | 81.82 | 7.4020 | 15 | −25.0 |
| Comparative Example 5 | Fluid A-3 | 52.02 | 6.055 | 34 | −27.5 |
| Example 5 | Fluid B-2 | 4471 | 34.11 | −407 | +10.0 |

What is claimed is:

1. A working fluid for traction drive use which comprises a decahydronaphthalene compound represented by the general formula

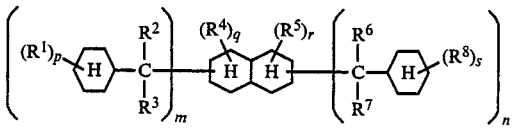

in which $R^1$, $R^2$, $R^3$, $R^4$, $R^5$, $R^6$, $R^7$ and $R^8$ are each a hydrogen atom or an alkyl group having 1 to 4 carbon atoms, the subscripts p, q, r and s are each a positive integer of 1, 2 or 3 and the subscripts m and n are each zero or a positive integer of 1, 2 or 3 with the proviso that m+n is 2 or 3.

2. The working fluid for traction drive use as claimed in claim 1 wherein the decahydronaphthalene compound is selected from the group consisting of bis(cyclohexyl methyl)decahydronaphthalene, bis(cyclohexyl ethyl)decahydronaphthalene, bis(1-methyl-1-cyclohexyl ethyl)decahydronaphthalene, bis(cyclohexyl methyl)methyl decahydronaphthalene, bis(1-cyclohexyl ethyl)methyl decahydronaphthalene, bis(-methylcyclohexyl methyl) decahydronaphthalene, bis[1-(methylcyclohexyl)ethyl]decahydronaphthalene, bis[1-methyl-1-(methylcyclohexyl)ethyl]decahydronaphthalene, bis(methylcyclohexyl methyl)methyl decahydronaphthalene, bis[1-(methylcyclohexyl)ethyl]-methyl decahydronaphthalene, bis[1-methyl-1-(methylcyclohexyl)ethyl]methyl decahydronaphthalene, tris(-cyclohexyl methyl)decahydronaphthalene bis(1-methyl-1-cyclohexyl ethyl)methyl decahydronaphthalene and tris(1-cyclohexyl ethyl)decahydronaphthalene.

3. A synergistic working fluid for traction drive use which comprises:

(A) a base oil having a kinematic viscosity not exceeding 8 centistokes at 100° C.; and (B) a decahydronaphthalene compound according to claim 2, the fluid having a kinematic viscosity of at least 3 centistokes at 100° C.

4. The synergistic working fluid for traction drive use as claimed in claim 3 wherein the amount of the decahydronaphthalene compound as the component (B) is in the range from 5 to 250 parts by weight per 100 parts by weight of the base oil as the component (A).

5. The synergistic working fluid for traction drive use as claimed in claim 3 wherein the base oil as the component (A) is selected from the class consisting of naphthenic base oils, aromatic base oils, paraffinic base oils, silicone-based base oils, esteric base oils and mixtures thereof.

6. The synergistic working fluid for traction drive use according to claim 4 in which the decahydronaphthlene compound is selected from the group according to claim 3.

* * * * *